US005598799A

United States Patent [19]

Badillo

[11] Patent Number: 5,598,799

[45] Date of Patent: Feb. 4, 1997

[54] BOBBIN BASKET WITH THREAD GROOVING PROTECTION MEANS

[75] Inventor: Paul Badillo, Littleton, Colo.

[73] Assignee: Bakron Corporation, Buffalo Grove, Ill.

[21] Appl. No.: 342,388

[22] Filed: Nov. 18, 1994

[51] Int. Cl.[6] ..... D05B 57/26

[52] U.S. Cl. ..... 112/231

[58] Field of Search ..... 112/185, 187, 112/196, 192, 232, 231, 181, 230

[56] References Cited

U.S. PATENT DOCUMENTS

| | | | |
|---|---|---|---|
| 1,504,241 | 8/1924 | Hohmann | 112/231 |
| 3,347,193 | 10/1967 | Perri | 112/231 X |
| 4,393,798 | 7/1983 | Cheng | 112/231 |
| 4,577,572 | 3/1986 | Hirose | 112/231 |
| 4,676,178 | 6/1987 | Hirose | 112/231 |
| 4,858,543 | 8/1989 | Badillo | 112/231 |
| 5,076,182 | 12/1991 | Hirose et al. | 112/231 |
| 5,188,046 | 2/1993 | Badillo | 112/231 |
| 5,413,058 | 5/1995 | Hirose et al. | 112/231 |

FOREIGN PATENT DOCUMENTS

| | | | |
|---|---|---|---|
| 91748 | 1/1967 | France | 112/231 |

*Primary Examiner*—Ismael Izaguirre

*Attorney, Agent, or Firm*—Wood, Phillips, VanSanten, Clark & Mortimer

[57] ABSTRACT

A bobbin basket for use with a rotary loop taker in a lock stitch sewing machine. The bobbin basket has an integrally formed bearing rib formed of synthetic resin affixed to a metallic cylindrical side wall. Thread grooving protection members are inserted into insert housings at specified areas where the needle thread loop slides against the thread pick up and thread cast off notches. The insert housings are self contained on the integrally formed bearing rib.

26 Claims, 2 Drawing Sheets

BOBBIN BASKET WITH THREAD GROOVING PROTECTION MEANS

FIELD OF INVENTION

The present invention relates to a bobbin case holder, commonly referred to as a bobbin basket, and more particularly to a bobbin basket having a metal cylindrical sidewall with a flange extending radially outward at its upper end, an integrally formed bearing rib formed of a resin material removably affixed to the side wall, to mate with the raceway of the rotary loop taker, the improvement being a means of protecting the bearing rib at its thread pickup and thread cast off ends from thread grooving damage.

Badillo U.S. Pat. No. 4,858,543 shows an integrally formed polymer bobbin basket having a metal needle hole protection member to protect the polymer against needle deflection as the needle penetrates through the needle bore hole. That invention proved to be highly effective when using smaller sized needles usually associated with lighter weight sewing. As the fabrics being sewn became heavier, thereby requiring larger needles with greater impact forces, it became clear the needle protection plate and its corresponding polymeric substrate could not handle the increased impact forces. Therefore a part having a sidewall formed of a stronger material and a removably affixed polymeric bearing rib would be required to achieve similar performance characteristics to Badillo's U.S. Pat. No. 4,858,543.

Cheng U.S. Pat. No. 4,393,798, dated Jul. 19, 1983, shows a metal cylindrical sidewall having a Teflon bearing rib detachably affixed. Cheng uses a three piece construction for his invention, including an upper cylindrical ring, a middle detachable affixed Teflon ring, and a lower cylindrical sidewall having a bottom end. The three parts are snap fit together to form the bobbin basket. This invention achieves the objective of protecting the needle bore hole from severe needle deflection because of the solid metal material surrounding the needle bore hole area. Further, Cheng's invention shows on FIG. 1 a metal fin protruding down to protect the thread pick up end of the bearing rib. Cheng's method of protecting the thread pick up and thread cast off ends from thread grooving is effective in that the metal fins protect against thread grooving. His problem is that the manufacturing process of a cylindrically formed sidewall with integrally formed fins is a very difficult and expensive undertaking. Furthermore, the concept of a three piece basket is an inferior construction considering both strength and tolerence criteria. Cheng's invention did not, to applicants knowledge, ever become a commercially viable product.

Hirose U.S. Pat. No. 5,076,182 also shows a substantially metallic cylindrical sidewall, that unlike Cheng is an integrally formed one piece construction. Hirose also includes a resin formed bearing rib ring to detachably affix to the metallic cylindrical sidewall. Hirose's bearing rib ring is 360° around and is affixed to the sidewall with screw means. In order for the bearing rib ring to be properly affixed to the sidewall, and maintain its smooth sidewall continuity, Hirose made a lower step portion on the lower end of the cylindrical sidewall so that the 360° degree ring can be axially slid into place. Hirose shows the thread pickup and thread cast off areas adapted to integrally join the surrounding portion in a smooth and seamless manner. Hirose avoids the problem of thread getting caught in any seams or gaps because his bearing rib is a 360° integrally formed ring which slides axially on the cylindrical sidewall from the bottom. The thread pick up and thread cast off areas are free from joints or seams. His problem is that the thread pickup and thread cast off notches are formed of a soft resin material and are completely unprotected against thread grooving.

Badillo in his U.S. Pat. No. 5,188,046, realized the detrimental effects that thread has on resin formed material, and utilized ceramic wear pins to prevent thread damage at specific locations. This was an excellent solution to the thread grooving problem as the thread could not groove through the high strength ceramic. The problem was that Badillo's invention was applied to an integrally formed polymeric basket which could not stand up to the high impact of large needles usually associated with heavy duty sewing.

SUMMARY OF THE INVENTION

With a view to solving the aforementioned problems, it is an object of this invention to provide a new and improved polymeric bobbin basket which provides performance characteristics cited in Badillo's previous inventions and yet still allow for heavy duty sewing without cylindrical sidewall breakage.

Another object of this invention is to provide an easier and less expensive means of protecting a basket with a metallic cylindrical sidewall and resin bearing rib from thread grooving at specific wear points.

In accomplishing the above objects, a bobbin basket according to the present invention comprises a generally cylindrical sidewall defining an open upper end and a crosswise support member at the lower end, a center post extending axially upwards from the approximate center of the crosswise support member, a flange extending radially outwards at the top of the cylindrical sidewall with portions of the flange adapted to form a rotation restraining notch, and an integrally formed bearing rib formed of a resin material detachably affixed to the cylindrical sidewall of the invention.

The bearing rib of this invention has two end portions which along with the adjacent sidewall form a "V" shaped notch defining the thread pick up and thread cast off notches. Located on the bearing rib at the thread pick up and thread cast off areas are insert housings within which damage resistant inserts are embedded. These damage resistant inserts are preferably cylindrical in shape and formed of a stronger and harder material than the material in which they are embedded. The material is preferably ceramic, but can be metal as well. The damage resistant members are inserted into the pockets preferably from the underside of the rib and need not extend completely to the top. The damage resistant members preferably have a single portion of their exterior exposed, which exposes a surface portion that is smooth, free from sharp edges, and substantially flush with the surrounding surface of the element in which the insert is embedded. The damage resistant member must be at least flush with the cylindrical sidewall and preferably below its surface so as to stop the thread from getting wedged between the seam that is formed by the junction of the bearing rib and the sidewall. The damage resistant inserts could be located at both the thread pick up or thread cast off areas, or at only one area as needed.

In the preferred embodiment, the bearing rib of this invention has a guide slot substantially throughout its inner circumference for cooperating with a metal strip guide flange integrally formed with and extending substantially around the cylindrical sidewall. This metal strip guide flange has end portions located approximately at the thread pick up or cast off areas of this invention. The insert housing extends radially inwards to abut against the end wall of the metal strip guide flange and extends below the surface of the adjacent cylindrical side wall. The guide slot of the bearing rib is press fitted to the metal strip guide of the cylindrical side wall or adhesivly attached.

DETAILED DESCRIPTION OF THE PREFERRED EMBODIMENT OF THIS INVENTION

Figure 1:
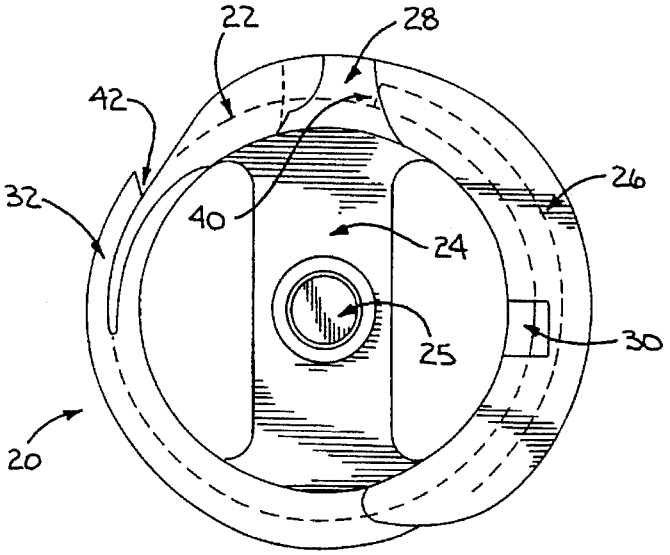
FIG. 1 is a top plan view of the complete assembled embodiment of this invention.

FIG. 1 shows in top plan view a bobbin basket 20, including cylindrical sidewall 22, and crosswise support member 24 extending across the bottom of bobbin basket 20. Bobbin basket center post 25 extends axially away from crosswise support member 24 into a space defined by cylindrical sidewall 22. Flange 26 extends radially from the top portion of the side wall. Restraining notch 28 is formed in the top surface of flange 26. A second notch 30 is located on the inside perimeter of flange 26 which accepts a projection from the bobbin case (not shown). Integrally formed bearing rib 32 is shown affixed to sidewall 22.

Figure 2:
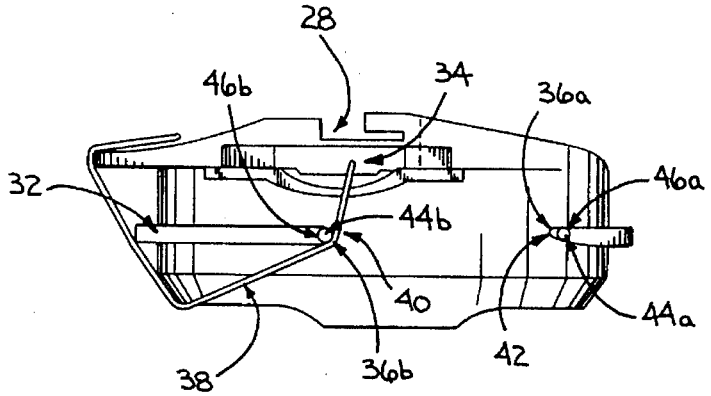
FIG. 2 is a side view of the complete assembled embodiment of this invention.

FIG. 2 shows a side view of this invention. A needle bore hole 34 is located directly below restraining notch 28. Oppositely facing end walls 36*a* and 36*b* are shown at the ends of integrally formed bearing rib 32. Needle thread loop 38 is shown in its taut position against cast off notch 40. Thread cast off notch 40 faces thread pick up notch 42. Inserts 44*a* and 44*b* are located within insert housings 46*a* and 46*b* respectively.

Figure 3:
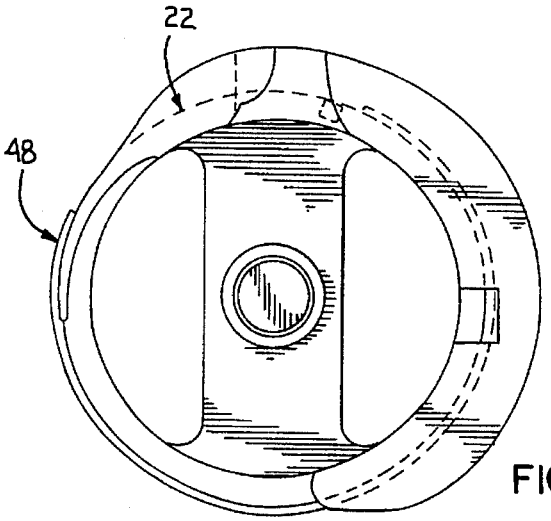
FIG. 3 is a top plan view of the bobbin basket of this invention without the affixed integrally formed bearing rib.

FIG. 3 shows a top plan view without the integrally formed bearing rib 32. Guide strip 48 extends radially outward for all but a small portion of the periphery of cylindrical side wall 22.

Figure 4:
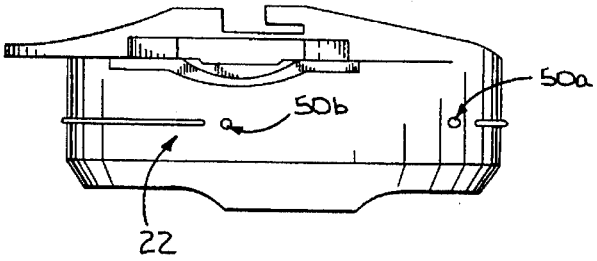
FIG. 4 is a side view of the bobbin basket of this invention without the affixed integrally formed bearing rib.

FIG. 4 show a side view of this invention without the integrally formed bearing rib 32. Cylindrical side wall 22 has holes 50*a* and 50*b* to accept the inserts 44*a* and 44*b*, as seen in FIG. 2. Holes 50*a* and 50*b* can either be dimpled or go completely through side wall 22. Inserts 44*a* and 44*b* must be below the surface of cylindrical sidewall 22.

Figure 5:
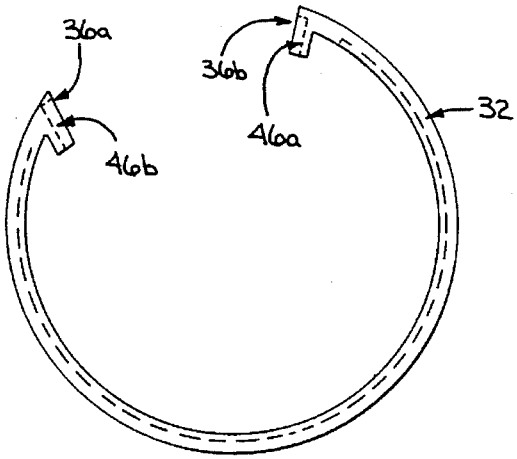
FIG. 5 is a top plan view of the integrally formed bearing rib of this invention.

FIG. 5 shows the top view plan of integrally formed bearing rib 32. Oppositely facing end walls 36*a* and 36*b* face each other with about 80° of cylindrical sidewall 22 in between. Insert housings 46*a* and 46*b* are formed within the end walls.

Figure 6:
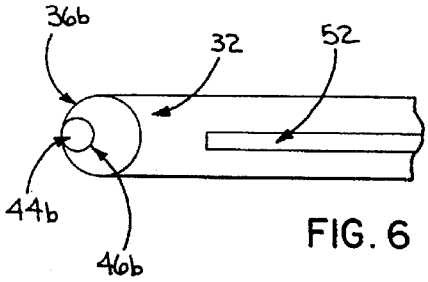
FIG. 6 is a fragmentary bottom plan view of the integrally formed bearing rib of this invention.

FIG. 6 shows a fragmentary plan view of the underside of integrally formed bearing rib 32 of this invention. Insert housings 46*a* and 46*b* are formed within oppositely facing end walls 36*a* and 36*b*. Inserts 44*a* and 44*b* fit into insert housings 46*a* and 46*b*, respectively, and are shown centered between the top and bottom of the bearing rib 38. Inserts 44*a* and 44*b* are bared to allow needle thread loop 38 to slide against. Guide slit 52 extends throughout the inner circumference of integrally formed bearing rib 32. Guide slit 52 mates with guide strip 48 shown in FIG. 3 in a secure and aligned manner. Inserts 44*a* and 44*b* extend below insert housings 46*a* and 46*b* respectively into holes 50*a* and 50*b*.

Figure 7:
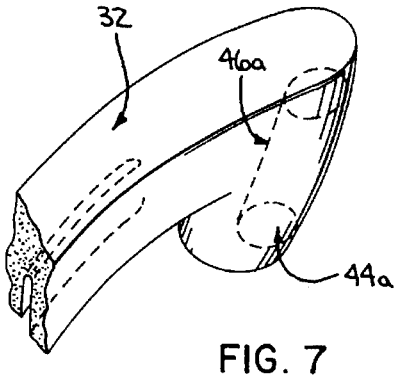
FIG. 7 is a fragmentary perspective view of the integrally formed bearing rib of this invention.

FIG. 7 shows a fragmentary perspective view of integrally formed bearing rib 32 of this invention. This view shows insert 44*a* embedded in a snug fit within insert housing 46*a*. Insert 44*a* is bared at its outermost point and exposes a surface portion that is smooth and free from sharp edges.

Figure 8:
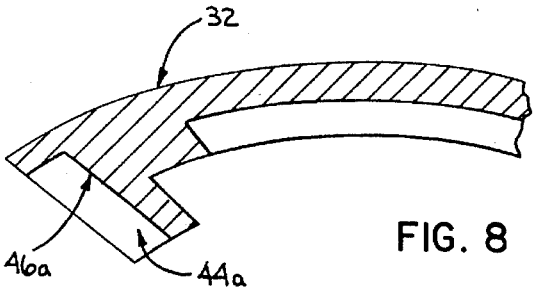
FIG. 8 is a fragmentary side view of the integrally formed bearing rib of this invention.

FIG. 8 shows a fragmentary top view of the integrally formed bearing rib 32 of this invention. Insert 44*a* is preferably inserted through the underside of integrally formed bearing rib 32. Glue means can be applied to insert housing 46*a* to insure a snug and secure fit.

SUMMARY, RAMIFICATIONS AND SCOPE

Accordingly, the reader will see that the objectives of this invention have been met.

It allows a bobbin basket with a synthetic resin bearing rib to be used with heavy needles and heavier fabric because its metal cylindrical side wall protects the needle bore hole.

It prevents the thread from grooving the end walls of the bearing rib.

It prevents the thread from wedging in the seam that is created at the junction of the bearing rib and the side wall.

It allows a inexpensive cost of manufacture.

Although the description above contains many specifities, these should not be construed as limiting the scope of the invention but merely providing one of the preferred embodiments of this invention. For example, there could be only one insert housing rather than the two specified in the preferred embodiment. The insert could be inserted from the top end rather than the underside of the insert housing.

Thus the scope of this invention should be determined by the claims and their legal equivalents, rather than by the examples given.

I claim:

1. A bobbin basket having a top and a bottom, said bobbin basket comprising:

a cylindrical sidewall that defines a substantially continuous peripheral surface, a bearing rib having a peripheral surface and spaced end walls;

means for attaching the bearing rib to the cylindrical sidewall in an operative position in which the peripheral surface of the bearing rib extends around at least a portion of the peripheral surface of the sidewall; and first means separate from the bearing rib defining in conjunction with the peripheral sidewall one of a thread pick up notch and a thread cast off notch at one of the spaced end walls, wherein the sidewall has a first receptacle and the bearing rib includes an insert housing that extends into the first receptacle on the sidewall to thereby limit peripheral movement of the bearing rib relative to the cylindrical sidewall.

2. A bobbin basket having a top and a bottom, said bobbin basket comprising:

a cylindrical sidewall comprising a single piece that defines a substantially continuous peripheral surface and extends substantially fully between the top and bottom of the bobbin basket, a bearing rib having a peripheral surface and spaced end walls; and means for attaching the bearing rib to the cylindrical sidewall in an operative position in which the peripheral surface of the bearing rib extends around at least a portion of the peripheral surface of the sidewall, wherein the sidewall has a first receptacle and the bearing rib includes an insert housing that extends into the first receptacle on the sidewall to thereby limit peripheral movement of the bearing rib relative to the cylindrical sidewall.

3. The bobbin basket according to claim 2 wherein the cylindrical sidewall and bearing rib are separately pre-formed and the means for attaching the bearing rib comprises means for attaching the pre-formed bearing rib to the pre-formed cylindrical sidewall.

4. The bobbin basket according to claim 2 wherein the cylindrical sidewall and bearing rib are made from different materials.

5. The bobbin basket according to claim 2 wherein the cylindrical sidewall is made from metal and the bearing rib is made from a synthetic resin material.

6. The bobbin basket according to claim 2 including first means on at least one of the bearing rib and sidewall for blocking passage of thread between one of the end walls on the bearing rib and the peripheral surface of the sidewall.

7. The bobbin basket according to claim 2 including first means separate from the bearing rib defining in conjunction with the peripheral surface of the cylindrical sidewall one of a thread pick up notch and a thread cast off notch adjacent to one of the spaced end walls.

8. The bobbin basket according to claim 7 wherein the first means comprises a cylindrical post extending into the cylindrical sidewall and the bearing rib with there being a surface on the cylindrical post exposed at the one of the thread pick up notch and the thread cast off notch.

9. The bobbin basket according to claim 2 wherein the means for attaching the bearing rib includes an elongate, curved guide strip on one of the cylindrical sidewall and the bearing rib and a complementary slit for receiving the curved guide strip on the other of the cylindrical sidewall and bearing rib.

10. The bobbin basket according to claim 9 wherein the guide strip is formed as one piece with one of the cylindrical sidewall and the bearing rib.

11. The bobbin basket according to claim 9 wherein the guide strip extends along at least the majority of the periphery of the one of the cylindrical sidewall and the bearing rib and the slit extends along at least the majority of the periphery of the other of the cylindrical sidewall and bearing rib.

12. The bobbin basket according to claim 2 wherein the bearing rib in the operative position resides between the top and bottom of the bobbin basket.

13. The bobbin basket according to claim 2 including an insert extending into the insert housing, wherein the insert is made from a material that is harder than the material that each of the cylindrical sidewall and bearing rib is made from.

14. The bobbin basket according to claim 2 wherein the means for attaching the bearing rib to the cylindrical sidewall comprises means for press fitting the bearing rib into the operative position in which the bearing rib is prevented from moving both circumferentially relative to the sidewall and relative to the sidewall between the top and bottom thereof.

15. The bobbin basket according to claim 2 wherein the means for attaching the bearing rib to the cylindrical sidewall comprises means for attaching the bearing rib consistently in the same location on the cylindrical sidewall.

16. The bobbin basket according to claim 2 wherein the insert housing is formed as one piece with the bearing rib.

17. A bobbin basket having a top and a bottom, said bobbin basket comprising:

a cylindrical sidewall comprising a single piece that defines a substantially continuous peripheral surface and extends substantially fully between the top and bottom of the bobbin basket, a bearing rib having a peripheral surface and spaced end walls;

means for attaching the bearing rib to the cylindrical sidewall in an operative position in which the peripheral surface of the bearing rib extends around at least a portion of the peripheral surface of the sidewall; and first means separate from the bearing rib defining in conjunction with the peripheral surface of the cylindrical sidewall one of a thread pick up notch and a thread cast off notch adjacent to one of the spaced end walls, wherein the first means comprises a cylindrical post extending into the cylindrical sidewall and the bearing rib with there being a surface on the cylindrical post exposed at the one of the thread pick up notch and the thread cast off notch, wherein the means for attaching the bearing rib includes an insert housing on the bearing rib, there being a receptacle in the cylindrical sidewall within which the insert housing projects and the post extends into the insert housing and the receptacle in the cylindrical sidewall.

18. A bobbin basket having a top and bottom, said bobbin basket comprising:

a cylindrical sidewall that defines a substantially continuous pierpheral surface;

a bearing rib having a peripheral surface; and means for fixedly attaching the bearing rib to the cylindrical sidewall in an operative position so that the bearing rib is prevented from moving both peripherally relative to the cylindrical sidewall and relative to the sidewall between the top and bottom of the bobbin basket, wherein the sidewall has a first receptacle and the bearing rib includes an insert housing that extends into the first receptacle On the sidewall to thereby limit peripheral movement of the bearing rib relative to the cylindrical sidewall.

19. The bobbin basket according to claim 18 wherein the means for attaching the bearing rib comprises means for press fitting the bearing rib into the operative position and maintaining the bearing rib in the operative position.

20. A bobbin basket having a top and bottom, said bobbin basket comprising:

a cylindrical sidewall that defines a substantially continuous peripheral surface;

a bearing rib having a peripheral surface and spaced end walls; and means for fixedly attaching the bearing rib to the cylindrical sidewall in an operative position so that the bearing rib is prevented from moving both peripherally relative to the cylindrical sidewall and relative to the sidewall between the top and bottom of the bobbin basket, wherein the means for attaching the bearing rib comprises means for press fitting the bearing rib into the operative position and maintaining the bearing rib in the operative position, wherein the attaching means comprises first and second receptacles on the cylindrical sidewall and first and second radially extending insert housings on the bearing rib that are received in the first and second receptacles with the bearing rib in the operative position.

21. The bobbin basket according to claim 20 wherein there is a post extending through one of the insert housings and into one of the receptacles.

22. The bobbin basket according to claim 21 wherein the post has a curved surface exposed radially outside of the cylindrical sidewall and defining in conjunction with the peripheral surface on the cylindrical sidewall one of a thread pick up notch and a thread cast off notch.

23. The bobbin basket according to claim 20 wherein the attaching means includes a peripherally extending guide strip on one of the cylindrical sidewall and bearing rib and a complementary peripherally extending guide slot on the other of the cylindrical sidewall and bearing rib.

24. A bobbin basket having a top and bottom, said bobbin basket comprising:

a cylindrical sidewall comprising a single metal piece that defines a substantially continuous peripheral surface and extends substantially fully between the top and bottom of the bobbin basket, said cylindrical sidewall having a cylindrical outer surface;

bearing rib made from a synthetic resin material and halving a peripheral surface and spaced end walls;

means for attaching the bearing rib to the cylindrical sidewall in an operative position in which the peripheral surface of the bearing rib extends around at least a portion of the peripheral surface of the sidewalls, said attaching means comprising spaced, first and second receptacles on the cylindrical sidewall and first and second radially projecting insert housings on the bearing rib which extend one each into the first and second receptacles, said attaching means further including a peripherally extending strip on one of the cylindrical sidewall and bearing rib and a complementary slot on the other of the cylindrical sidewall and bearing rib; and a first insert on one of the insert housings having an exposed surface defining in conjunction with the peripheral surface of the cylindrical sidewall at least part of one of a thread pick up notch and thread cast off notch.

25. The bobbin basket according to claim 24 wherein there is a second insert in the other of the inset housings with the second insert defining in conjunction with the peripheral surface of the cylindrical sidewall at least part of the other of a thread pick up notch and thread cast off notch.

26. The bobbin basket according to claim 25 wherein the first and second inserts are each made from a material that is harder than the synthetic resin material defining the bearing rib, and each said insert has a cylindrical shape and extends one each into the first and second receptacle in the cylindrical sidewall.

* * * * *